United States Patent [19]

Neumann

[11] 4,384,810

[45] May 24, 1983

[54] LOCKING BEAM TO FORM A THREE-DIMENSIONAL LATTICE IN A CONSTRUCTION SYSTEM FOR PLANTABLE SHORING WALLS

[76] Inventor: Herwig Neumann, Karl-Benz-Strasse, 7521 Forst/Baden/BRD, Fed. Rep. of Germany

[21] Appl. No.: 266,007

[22] Filed: May 21, 1981

[30] Foreign Application Priority Data

May 23, 1980 [DE] Fed. Rep. of Germany ..... 3019675

[51] Int. Cl.[3] ..... E21D 5/12

[52] U.S. Cl. ..... 405/284; 405/273

[58] Field of Search ..... 405/272–287; 47/66–72; 52/606, 608, 609

[56] References Cited

U.S. PATENT DOCUMENTS

| | | | |
|---|---|---|---|
| 1,268,649 | 6/1918 | Velde | 405/273 X |
| 1,600,081 | 9/1926 | Tufts | 405/287 |
| 2,098,263 | 11/1937 | Trumpour | 405/273 |
| 2,123,016 | 7/1938 | McDaniel | 405/273 |
| 2,972,870 | 2/1961 | Cooper | 405/273 |
| 4,229,123 | 10/1980 | Heinzmann | 405/273 |

FOREIGN PATENT DOCUMENTS

| | | | |
|---|---|---|---|
| 5412 | 11/1979 | European Pat. Off. | 405/284 |

*Primary Examiner*—Dennis L. Taylor

*Attorney, Agent, or Firm*—Shlesinger, Arkwright, Garvey & Dinsmore

[57] ABSTRACT

A locking beam to form a three-dimensional lattice in a construction system for plantable shoring walls comprising support blocks stacked one above the other with plane upper and under sides transversely to the longitudinal wall direction and acting as spacing means between individual planting level-forming longitudinal components consisting of a base plate and of a breast part joining same and always resting on two support blocks, each of the consecutive pairs of support block stacks forming together with the earth filled in them and the deposited longitudinal components a construction section acting as a static slope shoring unit is disclosed.

11 Claims, 5 Drawing Figures

Figure 1:
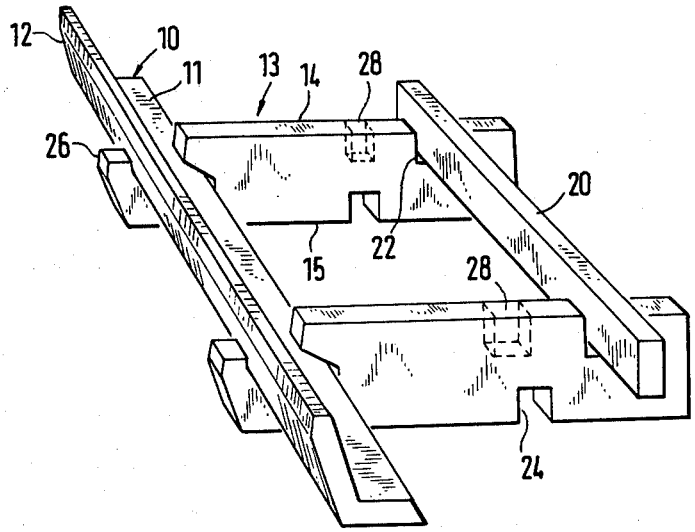

LOCKING BEAM TO FORM A THREE-DIMENSIONAL LATTICE IN A CONSTRUCTION SYSTEM FOR PLANTABLE SHORING WALLS

The invention concerns a construction system for plantable walls, acoustically insulating walls or slope shoring means, consisting of support blocks stacked one above the other with plane upper and under sides transversely to the longitudinal wall direction and acting as spacing means between individual planting level-forming longitudinal components consisting of a base plate and of a breast part joining same and always resting on two support blocks, each of the consecutive pairs of support block stacks forming together with the earth area filled in them and the deposited longitudinal components a construction section acting as a static slope shoring unit.

In the parent application, longitudinal components spanning neighboring stacks of support blocks in order to improve the frictional connection between support blocks resting on each other at the level of their foreshortenings are placed on lower support blocks for the purpose of forming throughs transmitting the earth load and are covered by the next higher support blocks with interposition of spacing means. Because the longitudinal components resting on the forward area of the support blocks load the support blocks by their own weights plus that of the earth resting on them, the said proposal also increases the load on the rear region anchored into the slope, with the flat-laid longitudinal components transmitting downward the earth pressure applied to them.

As the longitudinal elements resting on the front of the support blocks by their own weights and that of the earth in turn resting on them load the support blocks, the said proposed solution of the main invention also increases the load in the rearward region imbedded in the slope, whereby the flat-laid longitudinal components transmit downward the earth pressure exerted on them.

These load components used to increase frictional locking and transmitting the weight of the cone of earth above to the support blocks underneath require relatively deep imbeddings into the slope, i.e. long support blocks which are costly to manufacture and to ship and when being laid require much labor and vast earth working.

It is the object of the present invention to achieve a substantially improved statis strength for the supporting wall or slope shore means made from the described construction system and in particular to lessen the cost which previously was required by the necessary deep imbedments.

This problem is solved by the invention for a construction system of the initially mentioned type in that the support blocks at the same height and from a pair of adjoining stacks are used as the bearings for a locking beam which is imbedded into the earth of the slope at a substantial distance from the front longitudinal component in relation to the support block length and which essentially is enclosed at its lower half by upwardly open clearances in the two support blocks and at its upper half by two downwardly open clearances in two superposed support blocks.

By this design, one achieves on one hand a shape-locking connection in each stack of support blocks between superposed support blocks, whereby any kind of slippage within a stack of support blocks is excluded, and moreover simultaneously and advantageously a spatial or shoring lattice is formed by two adjoining support block stacks that in combination with the longitudinal components forwardly bounding the earth and the filled-in earth forms a slightly slanted column extending above the height of the shoring wall and extending continuously from top to bottom and, account of the loads which also are continuously transmitted from top to bottom secures the shoring wall in a statically proper manner, and a surprisingly simple way, against the slope forces. As slippage between the support blocks is impossible, and as moreover the load formed by the earth filled into the spatial lattice and by the weight proper of the spatial lattice elements is transmitted continuously and perforce increases downward, the previously required deep imbedments into the slope are necessary and hence also the resulting expansive earth work. Due to retaining the storied array of superposed support blocks even in large numbers for large slope shoring means, simple-manner forming and easy shipping and laying work is ensured, while at the same time there is intensive compaction of the earth areas which are filled level by level as the slope shore means is erected.

The basic construction has not changed with respect to a shoring wall built in accordance with one of the above described systems. In both cases two adjoining support block stacks with the earth filled-in between always form one unit. The spaces between these two units and also filled with earth and in which are located the gaps between the longitudinal components and the somewhat larger gaps (spaces) between the locking beams form earth columns half enclosed on each side by the adjacent spatial lattices and effective in the shoring of the slope while nevertheless permitting settling between the said units or construction sections without thereby however degrading the shoring function or the appearance of the wall as a whole.

While retaining the system of the longitudinally serial construction sections, the locking beams replace the loading elements which heretofore have been used to increase the frictional connection, whereby the relatively undetermined cone of earth lying above the load elements and deeply penetrating the slope now is advantageously superfluous because the weight component of the earth filled in the spatial lattice from top to bottom represents a ponderous column compensating the slope pressure. The locking beams in a way are located at the null line of loads between those from the slope and those of the earth column filled into the spatial lattice and accordingly require no significant strength or reinforcements.

The invention offers another advantage, namely that the front longitudinal components practically no longer are loaded by the slope pressure and hence can be used with little reinforcement in shoring walls of substantial heights. The slope forces are most extensively absorbed, i.e. neutralized in the area of the locking beams by the earth column filled in the 3-dimensional lattice.

Appropriately the locking beams and the clearances seating them are arranged in the vicinity of the support block ends pointing into the slope. In this manner one obtains a maximum cross section for the 3-dimensional lattice and for the earth column formed by the filled-in earth.

In another embodiment the locking beams are made somewhat shorter than the longitudinal components and thereby any difficulties when laying the locking elements and when erecting the 3-dimensional lattice are excluded. Also an easier fitting to a contour by the shoring wall is so achieved. The longitudinal spaces between the locking gaps however remain small enough for the earth filled into the 3-dimensional lattice to form a cohesive unit without any significant connected outward that the slope forces might penetrate in uncontrolled manner.

Preferably each support block is connected by one locking beam with the support block above and with the support block below and hence is secured against slippages. The height of a locking beam may be about half the height of the support blocks. The width of the locking beams located in the lower parts of a stack may exceed the width of locking beams located higher up. This means a saving in manufacturing costs and in the weight of these construction components and at the same time the inside cross-section of the 3-dimensional lattice remains as large as possible in the middle and upper regions of a shoring wall where relatively short support blocks are used.

Preferably the locking beams are rectangular or nearly rectangular in cross-section. In a further embodiment of the invention the locking beams comprise clearances at least at their upper or lower sides by means of which the support blocks of one pair at the same height are overlapped in their clearances, whereby the support blocks are secured against slippage in the direction of the wall. This feature assumes significance when erecting a shoring wall by longitudinal sections to fix the support blocks in their last stack, where the earth pressure is applied only from one side.

As regards another characteristic, the upper and lower clearances of all the support blocks are always arranged at the same lesser or the same larger spacing from the support block end. As a consequence, the rear side pointing toward the slope of a stack of support blocks will be of a constant inclination from top to bottom, though this inclination may be difficult from that at the visible side of the shoring wall when support blocks of different lengths are used.

In another embodiment, substantially long support blocks deeply entering the slope and used in the lower layers on account of definite static loads relating to an offset to the rear of the shoring wall comprise several clearances at their upper side to permit a relatively short support block deposited by means of its lower clearance on a relatively longer support block to be placed on a locking beam corresponding to the required rear offset at the front of the shoring wall. These additional clearances are significant for reasons of mass production of relatively long support blocks and their various applications. The uppermost support blocks of a stack can be interconnected by U or H clamps in lieu of locking beams, where these clamps engage both the upper and the lower clearances. This simplified clamping of superposed support blocks suffices at the upper levels of a wall, all the more so that when only relatively short support blocks are being used and the 3-dimensional lattice thusly formed withstands the slope forces which in this area are slight.

Various embodiments of the invention are discussed more comprehensively below in relation to the drawings.

Figure 2:
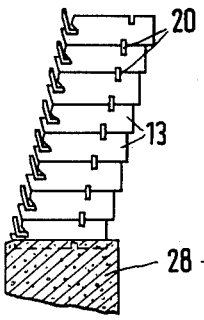
Figure 3:
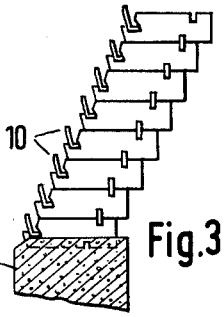
Figure 4:
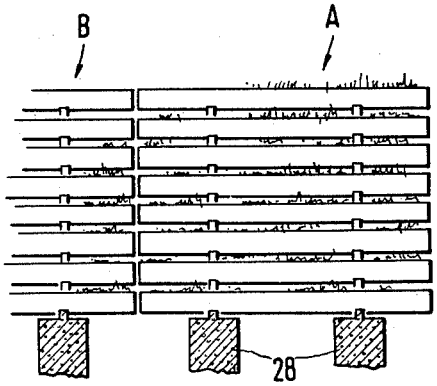
Figure 5:
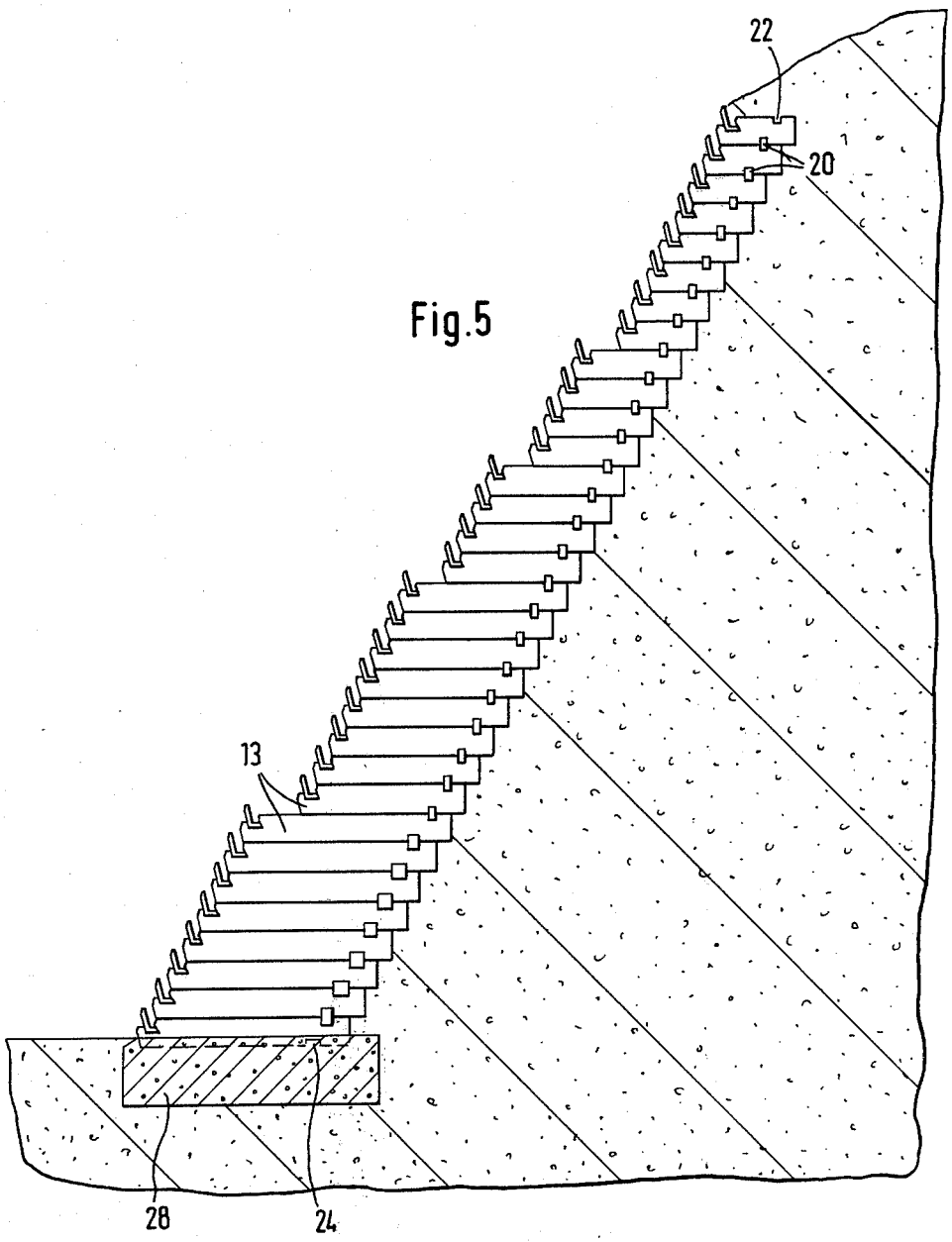

FIG. 1 is a perspective view of a pair of support blocks of a 3-dimensional lattice at one level with a forward longitudinal component and a rear locking beam, FIGS. 2 and 3 are schematic side views of shoring walls with various inclinations, FIG. 4 is a front view of the shoring wall of FIGS. 2 or 3, FIG. 5 is a side view of a relatively high shoring wall of the invention.

As shown in FIG. 1, two adjacent support blocks 13 belonging to a construction section A or B (FIG. 4) are provided at their front end with upwardly pointing projection 26 bounding on the front side a bearing surface for the inserted longitudinal component 10. The longitudinal component is inserted into the upwardly open clearance bounded forward by the projection and consists of a forwardly slanted relatively long breat part 12 and a joining shorter bottom plate 11. The support blocks 13 are provided with a plane upper side 14 and also a plane under side 15.

In order to form a 3-dimensional lattice, a locking beam 20 is deposited on the two support blocks 13 of FIG. 1; this beam 20 is received at its lower half in upwardly open clearances 22 in the upper side of the support blocks and is overlapped by downwardly clearances 24 in support blocks above of the next level. In this manner one locking beam 20 locks as a pair against longitudinal slippages. The upper clearances 22 are located closer than the lower ones 24 to the rearward end of the support blocks, determining thereby the rearward offset of the superposed support blocks and hence the wall inclination. FIGS. 2 and 3 show illustrative embodiments for walls of different inclinations. The lowermost support blocks in each case are anchored in a foundation 26.

As shown in FIG. 4, the wall consists of serial construction sections A,B . . . in its longitudinal direction. Each construction section is formed by a pair of adjacent stacks of support blocks, this stack being complemented as shown in FIG. 1 by the longitudinal components 10 placed at the front and the locking beams laid in the rear of the support block so as to form a 3-dimensional lattice. As the shoring wall is built up level by level, the 3-dimensional lattice gradually rising is constantly filled with earth and compacted, whereupon the next level is deposited.

FIG. 5 shows a relatively high shoring wall about 16 m high, the stacks of support block being built up by support blocks 13 of different lengths. FIG. 5 shows that cross-sectionally square locking elements 20 are placed in the clearances of the lower, longer support blocks, whereas the locking elements above are rectangular in cross-section and upright on their narrow side. Clearances at the same distance from the back are arranged in all the support blocks of this wall. As a result the 3-dimensional lattice inclines at a constant angle to the slope. The load from the 3-dimensional lattice and that of the column of earth filled into said lattice is transmitted continuously down in the direction of the slope, so that optimal slope shoring is achieved and without the possibility of the support blocks slipping with respect to each other. FIG. 5 also shows that the inclination at the visible side of the wall is shallower because a total of five different types of support blocks are used.

The support blocks 13 of FIG. 1 comprise additionally clearances 28 at the upper side 14; the locking beam 20 is placed into these clearances 28 when the next upper support block should be less in length.

I claim:

1. A system of construction components for erecting plantable walls, acoustically insulating walls or slope shorings, consisting of stacks of support blocks with plane upper and lower sides and arranged along the lengthwise direction of the wall as spacing means between longitudinal components forming individual planting levels, said longitudinal components consisting of a base plate and of a breast part and resting each on two support blocks, each of the pair of support block stacks sequential in the longitudinal direction of the wall together with the earth filled in between and the forwardly laid longitudinal components forming a construction section as the static slope shoring unit, characterized in that the support blocks (13) arranged at the same height and belonging to a pair of adjacent stacks act as the bearing for a locking beam (20) which is imbedded into the slope at a substantial distance with respect to the front longitudinal component (10) into the earth of the slope and which essentially is encompassed at its lower end by upwardly open clearances (22) in both support blocks and essentially is encompassed at its upper end by downward open clearances (24) in two support blocks (13) thereabove, and in that pairs of support blocks (13, 13), longitudinal components (10) and locking beams (20) arranged at superposed levels form a three-dimensional lattice abutting the slope and forming by its own weight plus that of the earth filled in the three-dimensional lattice a column of earth withstanding the slope forces that occur, but which in the top region of the wall and for relatively low shoring walls forms by means of U-shaped and H-shaped short locking beams only a column of earth (22, 24) bounded on three sides.

2. System of construction components per claim 1, characterized in that the locking beams (20) and clearances (22, 24) receiving them are arranged in the vicinity of the ends of the support blocks (13) pointing into the slope.

3. System of construction components per claim 1, characterized in that the locking beams (20) are somewhat shorter than the longitudinal components (10).

4. System of construction components per claim 1, characterized in that each support block (13) is joined with the support block above and the support block below by one locking beam each and hence is secured against slippage.

5. System of construction components per claim 1, characterized in that the height of a locking element corresponds to about half the support block height.

6. System of construction components per claim 1 through 5, characterized in that the width of those locking beams (20) which are located in the lower areas of a pair of support block stacks exceeds the width of those locking beams located at greater elevations of the wall.

7. System of construction components per claim 1, characterized in that the cross-section of the locking beams in rectangular or approximately so.

8. System of construction components per claim 1, characterized in that the locking beams (20) themselves comprise clearances at least at their upper or their under sides with which to span the clearances in a pair of support blocks located at the same height.

9. System of construction components per claim 2, characterized in that the upper and lower clearances (22, 24) of all the support blocks are always arranged at the same smaller and the same larger distance resp. from the end of the support block.

10. System of construction components per claim 9, characterized in that the longer support blocks (13) reaching deeper into the slope comprise several upper clearances (22, 28).

11. System of construction components per claim 1, characterized in that the uppermost support blocks of a stack are joined together by U-shaped or H-shaped clamps in lieu of locking beams, said clamps engaging the upper and lower clearance (22, 24).

* * * * *